US009216363B2

(12) United States Patent
Sullivan

(10) Patent No.: US 9,216,363 B2
(45) Date of Patent: Dec. 22, 2015

(54) FLYING TOY FIGURINE

(71) Applicant: Spin Master Ltd., Toronto (CA)

(72) Inventor: Timothy Michael Sullivan, Clarence, NY (US)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 13/865,369

(22) Filed: Apr. 18, 2013

(65) Prior Publication Data

US 2014/0227932 A1 Aug. 14, 2014

(30) Foreign Application Priority Data

Feb. 8, 2013 (CA) ..... 2804810

(51) Int. Cl.
*A63H 27/127* (2006.01)
*A63H 27/00* (2006.01)
*A63H 3/36* (2006.01)

(52) U.S. Cl.
CPC ..... *A63H 27/12* (2013.01); *A63H 3/36* (2013.01); *A63H 27/00* (2013.01)

(58) Field of Classification Search
CPC ..... A63H 3/36; A63H 27/14; A63H 27/12; A63H 30/04; A63H 27/00; A63H 7/00; A63H 30/00; B64C 39/001; B64C 27/20; B64C 2201/027; B64C 2201/042; B64C 2201/108; B64C 2201/146; B64C 27/32
USPC ..... 446/34, 36, 37, 41, 42, 57, 71, 72, 234, 446/268, 236, 255, 256
See application file for complete search history.

(56) References Cited

U.S. PATENT DOCUMENTS

| | | | | | |
|---|---|---|---|---|---|
| 447,284 | A | * | 2/1891 | Del Valle | 446/42 |
| 2,397,632 | A | * | 4/1946 | Stuart | 244/7 B |
| 2,949,693 | A | * | 8/1960 | McRoskey | 446/37 |
| D199,852 | S | * | 12/1964 | Johmann | D21/438 |
| 3,394,906 | A | * | 7/1968 | Rogers | 244/23 R |
| 3,479,764 | A | * | 11/1969 | Glass et al. | 446/44 |
| 3,995,392 | A | | 12/1976 | Goldfarb et al. | |
| 4,065,873 | A | * | 1/1978 | Jones | 446/37 |
| 4,531,692 | A | * | 7/1985 | Mateus | 244/17.19 |
| 5,525,086 | A | * | 6/1996 | Gentile et al. | 446/41 |
| D377,058 | S | * | 12/1996 | Henley | D21/593 |

(Continued)

FOREIGN PATENT DOCUMENTS

| | | | |
|---|---|---|---|
| CN | 2530700 | Y | 1/2003 |
| WO | 2006076743 | A1 | 7/2006 |

*Primary Examiner* — Vishu Mendiratta
(74) *Attorney, Agent, or Firm* — Bruzga & Associates; Charles E. Bruzga; Jay S. Pattumudi

(57) ABSTRACT

A flying toy figurine includes a main body having an upper body portion, a lower body portion and a middle body portion, the middle body portion including a waist portion and a hip portion. A center shaft connects the upper body portion to the lower body portion, and the waist portion and the hip portion are mounted for independent rotation about the center shaft. A motor drives a rotor assembly, including at least two main propeller blades, located in the waist portion in one direction for imparting vertical aerodynamic lift to the figurine. Rotation of the waist portion in one direction causes the hip portion to counter-rotate in the opposite direction. The center shaft is not connected to the waist portion or the hip portion and therefore rotation of the upper body portion and lower body portion remains independent of the rotation of the waist portion and the hip portion.

18 Claims, 6 Drawing Sheets

(56) References Cited

U.S. PATENT DOCUMENTS

| | | | | |
|---|---|---|---|---|
| 6,042,451 | A * | 3/2000 | Feldman | 446/330 |
| 6,843,699 | B2 * | 1/2005 | Davis | 446/37 |
| 7,100,866 | B2 | 9/2006 | Rehkemper et al. | |
| 7,416,466 | B2 | 8/2008 | Isawa | |
| 7,445,536 | B2 | 11/2008 | Lee et al. | |
| 7,946,526 | B2 * | 5/2011 | Zimet | 244/17.19 |
| 8,272,917 | B2 | 9/2012 | Davis | |
| 8,282,437 | B2 | 10/2012 | Norman et al. | |
| 8,639,400 | B1 * | 1/2014 | Wong | 701/4 |
| 2004/0200924 | A1 | 10/2004 | Clark, Jr. et al. | |
| 2008/0207079 | A1 | 8/2008 | Corsiglia et al. | |
| 2012/0231696 | A1 | 9/2012 | Xu | |
| 2014/0091942 | A1 * | 4/2014 | Matloff et al. | 340/815.53 |

* cited by examiner 31
33
34
34
34
34
33
33
31
34
34
34
34

FLYING TOY FIGURINE

FIELD OF THE INVENTION

This invention relates to toy figurines and in particular to toy figurines that include rotating propeller systems that impart vertical aerodynamic lift to the figurine, and control systems for automatically controlling the height of the figurine above a surface or other objects. It also relates to flying toy figurines where the body of the figurine is not fixed to the propeller system and therefore does not rotate, or rotates more slowly than the propellers to thereby provide a further sense of enjoyment and amazement to the user.

BACKGROUND OF THE INVENTION

U.S. Pat. No. 5,525,086 to Gentile at al., and U.S. Pat. No. 8,282,437 to Norman at al., describe launchable toy figurines. Gentile at al. describes a launchable figurine that includes a set of wings capable of providing aerodynamic lift upon rotation of the figurine. The wings are hinged to the body of the figurine so that they are free to move to an outstretched position to provide lift as rotation is imparted to the figurine. Gentile at al. does not disclose that the wings are attached to and form part of the skirt of the figurine, or that the figurine does not rotate or rotates at a speed that is slower than the rotating propellers.

Norman at al., discloses a launchable doll having wings fixed to the body of the doll between a torso portion and waist portion to provide aerodynamic lift to the doll when the doll rotates. The wings may be hinged to allow the doll to "sit", and to provide a "skirt" for the doll. However, Norman does not describe that the doll does not rotate or rotates at a speed that is much slower than the rotating propellers, or that the propellers may be weighted at their bottom edges. In fact, the propellers of Norman are fixed to the doll and the doll and the propellers rotate at the same rate of speed.

U.S. Published Patent Application No. 2004/0200924 to Clark at al. describes a vertical take off and landing aircraft that has a fuselage with a plurality of fins fixed thereto, and a rotor assembly driven by an electric motor located atop the fuselage with rotating blades to provide lift. When the rotor assembly rotates, the toy ascends and the fuselage counter-rotates. Rotation of the fuselage is slowed by the fixed fins attached thereto. While Clark at al. teaches a main body that rotates at a lower rate than the rotating lifting blades, Clark at al. does not teach a main body that comprises upper and lower portions that do not rotate or rotate at different rates of speed than the lifting blades of the rotor assembly.

A flying toy figurine that includes a main body having an upper portion, a middle portion, and a lower portion, where the upper portion and the lower portion do not rotate, or rotate at a much slower rate of speed than the propellers of the propeller system that provide vertical lift to the flying toy figurine is not shown in the prior art known to the inventor, and would provide more astonishment to the user and provide for more engaging play than previous flying toy figurines.

SUMMARY OF THE INVENTION

The present flying toy figurine addresses the shortcomings of the prior art.

In accordance with one aspect then, there is provided a flying toy figurine comprising: a main body, the main body comprising an upper body portion, a lower body portion and a middle body portion, the middle body portion comprising a waist portion and a hip portion; a center shaft located on a central axis of the main body, a first end of the center shaft being fixed to the upper body portion and a second, opposite end of the center shaft being fixed to the lower body portion; a drive motor for driving a rotor assembly, the rotor assembly including at least two main propeller blades for providing aerodynamic lift to the flying toy figurine, the rotor assembly located in the waist portion; a source of power for running the drive motor; a control system for regulating the operation of the drive motor; wherein the waist portion and the hip portion are mounted for independent rotation about the center shaft, said independent rotation of the waist portion and the hip portion being independent of rotation of the center shaft; wherein running the drive motor to drive the rotor assembly and waist portion in a first rotational direction imparts aerodynamic lift causing the flying toy figurine to fly and further imparts a counter-rotational force to the hip portion causing the hip portion to rotate in a second rotational direction opposite the first rotational direction; and wherein the center shaft remains independent of the rotation of the waist portion and the hip portion.

In accordance with other aspects, the drive motor may be located in the hip portion. The center shaft may extend through a center tube for rotation therein, and the center tube may be fixed to the hip portion. The main propeller blades may be hingeably connected to the rotor assembly and the rotor assembly may include a pair of stabilizer bars extending from the waist portion for rotation therewith. As a safety feature, the outer tips of the main propeller blades may include protective wire loops. The hip portion may include at least two secondary propeller blades connected to and extending radially outward thereof to provide the accoutrements of a skirt to the figurine and to slow the rotation of the hip portion. The secondary propeller blades may be hingeably connected to the hip portion and may be weighted along bottom edges thereof. The secondary propeller blades may be connected to the hip portion at an angle relative to the central axis so as to encounter downwash from the main propeller blades to provide further rotational resistance. The control system may include a transmitter/receiver combination to control and maintain the height of the flying toy figurine above a surface or object by measuring the strength of flight control signals reflected off of the surface and adjusting the amount of power transmitted to the motor relative to the strength of the reflected flight control signals. The control system may also include a receiver for receiving wireless control signals and a remote transmitter for transmitting the wireless control signals to the receiver, and control circuitry for turning the motor on and off and for controlling and maintaining the height of the flying toy figurine above a surface in response to the wireless control signals. The control system may include a motor cut-off switch to cut power to the drive motor when electric current to the drive motor increases above a predetermined amount.

BRIEF DESCRIPTION OF THE DRAWINGS

Referring to the drawings wherein like reference numerals indicate similar parts throughout the several views, several aspects of the flying toy figurine are illustrated by way of example, and not by way of limitation, in detail in the figures, wherein.

DETAILED DESCRIPTION OF THE INVENTION

Various embodiments of the flying toy figurine will now be discussed in detail/The following detailed description will proceed with reference to a particular illustrated embodiment. However, the embodiment shown on the drawings is presented only as an example of the claimed subject matter, and should be considered not as limiting the scope of the invention.

Figure 1:
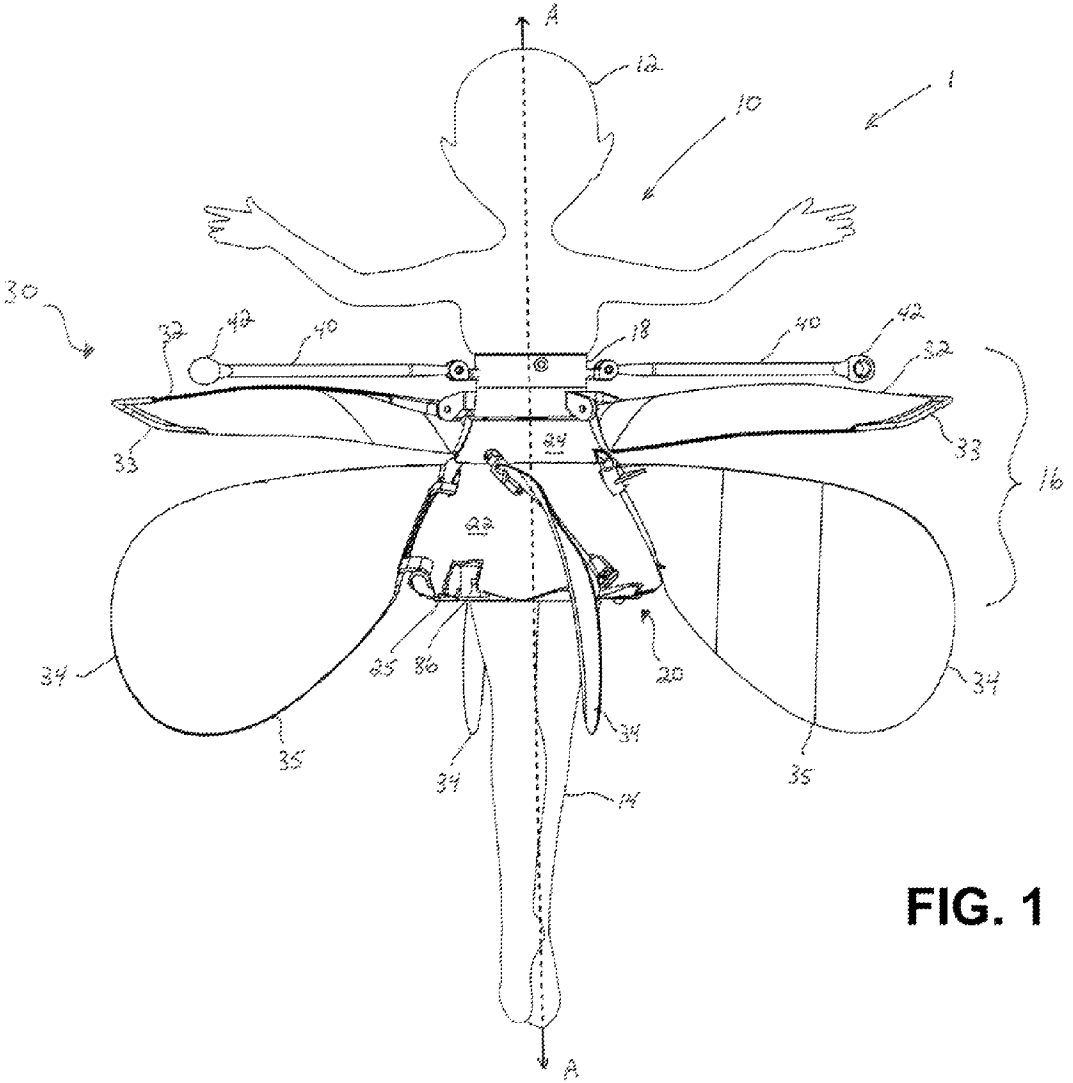
FIG. 1 is a front view of one embodiment of the flying toy figurine shown in the operating position.

FIG. 1 shows a front view of the flying toy figurine 1 including a main body 10. The main body 10 has an upper body portion 12, a lower body portion 14, and a middle body portion 16. The upper body portion 12 includes generally a head, arms and upper torso of the figurine 1, and may be comprised of two or more sections that fit together, such as a front upper body portion 12*a* and a rear upper body portion 12*b* (see exploded view in FIG. 2). Lower body portion 14 includes generally a lower part of the legs of the figurine 1 and may be comprised of two or more sections that fit together, such as a front lower body portion 14*a* and a rear lower body portion 14*b* (see exploded view in FIG. 2). The middle body portion 16 includes a waist portion 18 and a hip portion 20. The hip portion 20 includes a skirt 22, a skirt collar 24 fixed to the top of the skirt 22, and a skirt bottom 25 fixed to the bottom of the skirt 22. Skirt collar 24 includes attachment pegs 27 that fit into holes in the top of the skirt 22 for attaching the skirt collar 24 to the skirt 22.

Upper body portion 12 and lower body portion 14 are fixed together on a center shaft 70 running longitudinally on a central axis A of main body 10. Center shaft 70 is secured at one end to an upper body fixer 72 and at the other end to a lower body fixer 74. Upper body portion 12 is affixed to upper body fixer 72, while lower body portion 14 is affixed to lower body fixer 74. Center shaft 70 extends through a center tube 61 that runs through the main body 10 centered on the central axis A. Center tube 61 is fixed to hip portion 20 for rotation therewith about center shaft 70. Center shaft 70 is free to rotate within center tube 61. As described below, waist portion 18 and hip portion 20 are mounted for independent rotation about central axis A, such rotation also being independent of the rotation of upper body portion 12 and lower body portion 14, which are fixed together for synchronized rotation.

Figure 2:
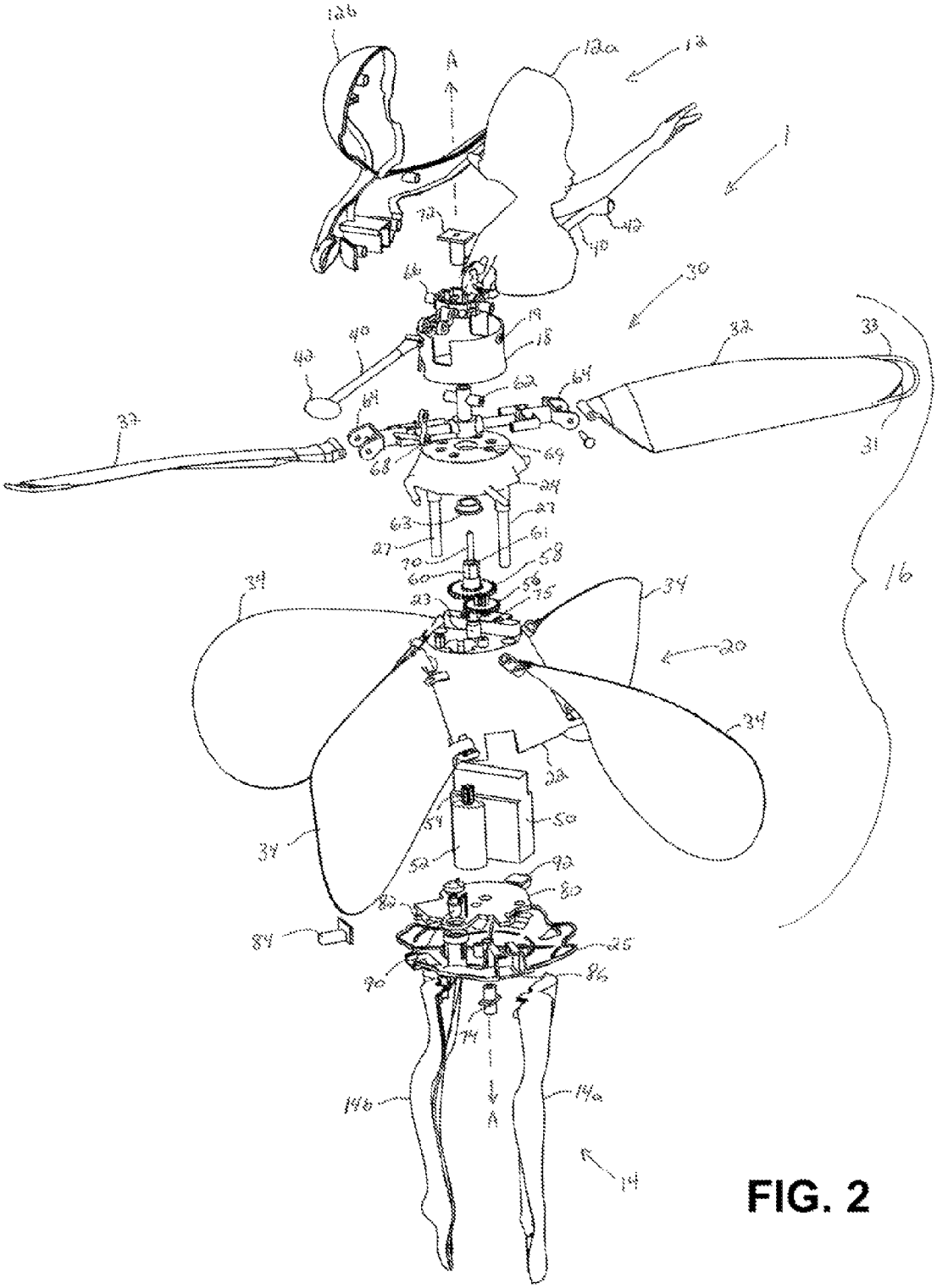
FIG. 2 is an exploded view of the flying toy figurine shown in FIG. 1.

As shown in FIGS. 1 and 2, waist portion 18 of middle body portion 16 includes a rotor assembly 30, which provides aerodynamic lift to the flying toy figurine 1. Rotor assembly 30 includes two or more main propeller blades 32, extending from the waist portion 18. Main propeller blades 32 are attached to a main rotor pivot 62 by propeller fixers 64, and may be hinged, as shown, so that when the propeller blades are not rotating they will fall to a somewhat more vertical position, thus providing the accoutrements of a skirt for the figurine.

Included in the rotor assembly 30, and configured for synchronized rotation with main propeller blades 32, are stabilizer bars 40 extending from the waist portion 18, each stabilizer bar terminating in a bell-shaped stabilizer mass 42. The stabilizer bars 40 are attached to a main rotor pivot 62 by a stabilizer fixer 66, and may also be hinged, as shown in FIGS. 1 and 2, for the same purpose as indicated for the main propeller blades 32. Waist portion 18 is attached to the stabilizer fixer 66 by pins 19 on either side of the waist portion.

As shown in FIGS. 1 and 2, main propeller blades 32 may be equipped with protective wire loops 33 surrounding outer tips 31 of the main propeller blades. Wire loops 33 have a round cross-section, are lightweight, and somewhat flexible. In the event the main propeller blades 32 come in contact with delicate human skin, wire loops 33 are designed to prevent the thin tip of the propeller blade from touching the skin. The lightweight wire loops 33 have a negligible effect on performance of the main propeller blades 32.

Hip portion 20 includes a set of two or more uniformly spaced secondary propeller blades 34 attached to the skirt 22 and the skirt collar 24 and extending radially outward thereof. Secondary propeller blades 34, are not driven, but rather are allowed to spin freely with the hip portion 20 in a direction opposite to the direction of rotation of the waist portion 18 and the main propeller blades 32 in response to rotational forces produced by rotation of the main propeller blades 32. Secondary propeller blades 34 may have a tear drop or petal shape as shown in the figures, so as to increase their surface area and provide some additional rotational resistance, thereby slowing their rotation and increasing the lift produced by the main propeller blades 32. Secondary propeller blades 34 may also be weighted on their lower edges 35 to further increase rotational resistance and improve lift. In the embodiment shown in FIG. 1, the applicant has shown four secondary propeller blades 34, however, it will be understood by those skilled in the area, that fewer or a greater number of secondary propeller blades 34 could be used. The secondary propeller blades 34 may be hinged to the hip portion 20 as shown in FIG. 1, so that when the secondary propeller blades are not rotating they will fall to a folded, somewhat more vertical position, thus providing the accoutrements of a skirt for the figurine. The bottom edges 35 of lower propeller blades 34 may be weighted to further assist the blades into the folded position and to provide additional rotational resistance, as mentioned above.

Contained internal of the skirt 22 portion of hip portion 20, and attached thereto, is a battery 50 for providing power to a drive motor 52, for providing motive force to the rotor assembly 30. Both the battery 50 and drive motor 52 are electrically connected to a circuit board 80, which is fixed to the skirt bottom 25. Circuit board 80 includes an on-off switch 82, having a switch cover 84. Also included on circuit board 80 is a charging port 86 for connection to a charging unit for recharging battery 50.

Figure 3:
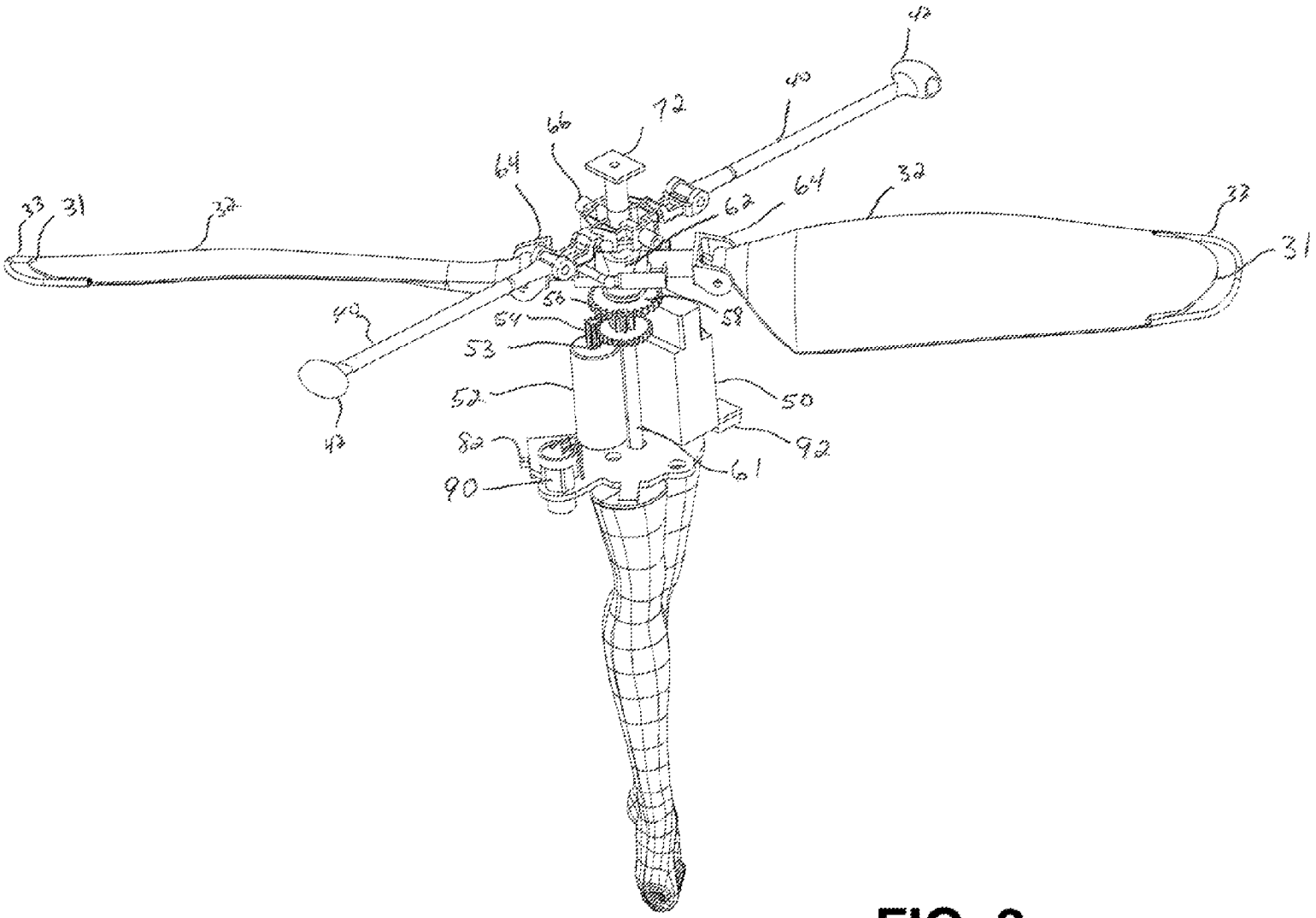
FIG. 3, is a partially assembled view showing some of the internal drive components of one embodiment of the flying toy figurine.
Figure 6:
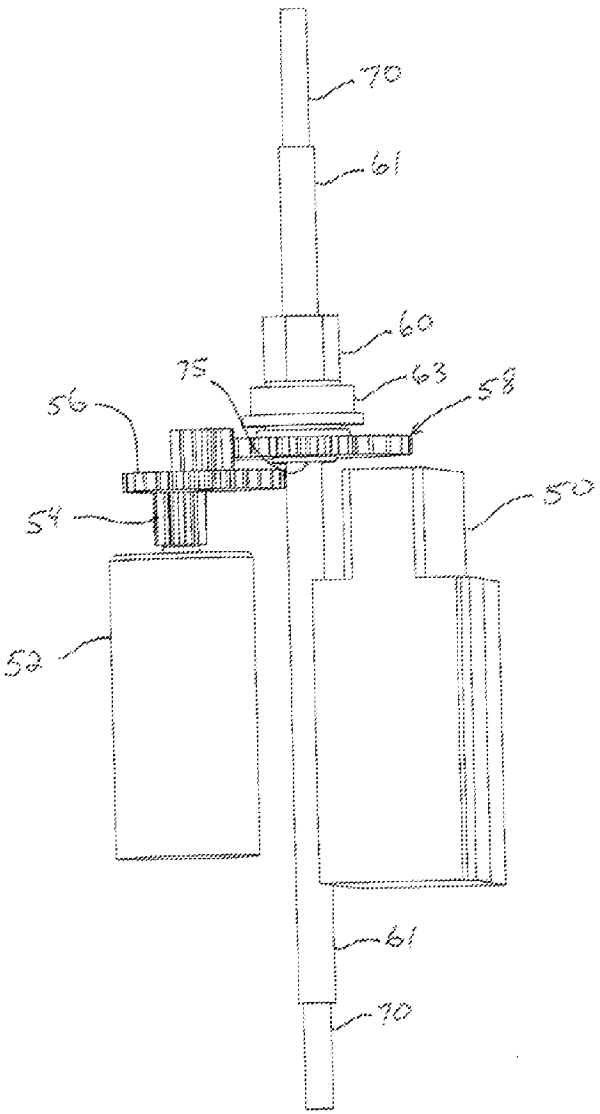
FIG. 6 is a partially assembled view of the flying toy figurine showing the motor, the battery, the drive gears, the gear plate and the top bearing.

As shown in FIGS. 2, 3, and 6, the drive motor 52 includes an output shaft 53 connected to a pinion gear 54. A main rotor drive gear 58 includes a main rotor drive shaft 60. Pinion 54 is drivingly coupled to the main drive gear 58 and the main rotor drive shaft 60 through a compound transmission gear 56 mounted to a post on the top of skirt 22. The main drive gear 58 sits for rotation on top of a gear plate 75 located on top of a center skirt tube 23 fixed to the top of skirt 22. Gear plate 75, preferably made of metal, acts as a bearing to reduce friction between the main gear 58 and the skirt 22.

A top bearing 63 is located on main drive gear 58 centered on main rotor drive shaft 60. Skirt collar 24 is fixed to top bearing 63 and is therefore free to rotate with top bearing 63, independent of the main drive gear 58. Skirt collar 24 is fixed to skirt 22. The main rotor drive shaft 60 extends through a hole 69 in the top of skirt collar 24 and drivingly connects to the main rotor pivot 62, which is in turn connected to main propeller blades 32 by propeller fixers 64 that extend through slots in the waist portion 18. Main rotor pivot 62 is further drivingly connected to stabilizers 40 by the stabilizer fixer 66 that extends through slots in the waist portion 18. A linkage 68 connects one side of the stabilizer fixer 66 to one of the propeller fixers 64.

Running motor 52 causes rotation of pinion gear 54, which engages transmission gear 56 and causes rotation of the main drive gear 58 and rotor shaft 60. Engagement of the main rotor shaft 60 with the main rotor pivot 62 causes rotation of the main rotor pivot 62. Engagement of the main rotor pivot 62 with the propeller fixers 64 causes rotation of the main propeller blades 34, thereby providing lift to the flying toy figurine 1. Engagement of the main rotor pivot 62 with the stabilizer fixer 66 causes rotation of stabilizers 40. Rotation of stabilizers 40 is thereby synchronized with rotation of the main propeller blades 34.

Linkage 68 between lower propeller fixer 64 and stabilizer fixer 66 is a common helicopter design that takes advantage of gyroscopic forces and is intended to stabilize the lower propeller blades 32 in windy conditions or if the flying toy figurine 1 encounters air flow from an air conditioner.

The freely rotating center shaft 70 extends longitudinally through center tube 61 that runs through main body 10 centered on the central axis A. Center tube 61 runs through and is fixed to the skirt tube 23 and therefore rotates with hip portion 20. Center tube 61 extends from the top of the main rotor pivot 62 to the skirt bottom 25, running through, but not fixed to, the main rotor pivot 62, the main drive gear 58, the gear plate 75, circuit board 80, and skirt bottom 25. Center shaft 70 therefore extends through the center of middle body portion 16 and is independent of the rotation of waist portion 18, including rotor assembly 30, and hip portion 20. Upper body portion 12 and lower body portion 14 are thus configured to remain stationary, independent of the rotation of the waist portion 18, including the main propeller blades 32, and independent of the rotation of the hip portion 20, including the secondary propeller blades 34.

Secondary propellers 34 are connected to the skirt 22 and to the skirt collar 24 of hip portion 20 for rotation therewith. When the rotor assembly 30 is spinning, hip portion 20, including the secondary propeller blades 34, spins on top bearing 63 in the opposite direction of propeller blades 34, at a proportional rate, in response to counter-rotational torque produced by driving the rotor assembly 30. In the absence of any restraint, the rate of rotation of the secondary propeller blades 34 would leave lithe of the motor's torque available to provide lift. It is therefore desirable to slow the rate of rotation of the secondary blades to provide increased lift. This is accomplished by increasing drag produced by the secondary propeller blades 34 by enlarging the size of the secondary propeller blades or by adding weight. Drag may also be increased by orienting the blades at an angle relative to the central axis "A" as shown in FIGS. 1 and 2. In this configuration, downwash from the main propeller blades 32 exerts a further anti-rotational force on secondary propellers 34.

Figure 4:
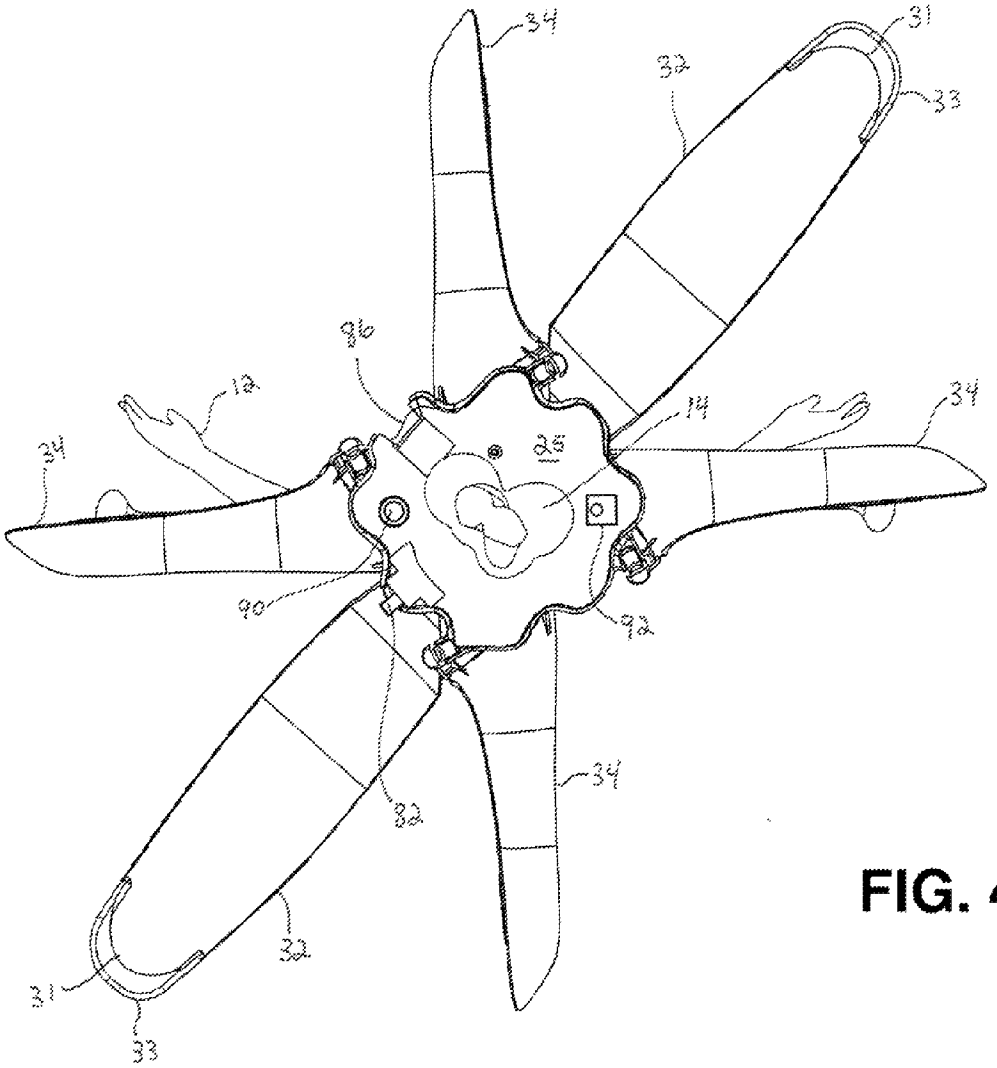
FIG. 4 is a bottom view of one embodiment of the flying toy figurine.
Figure 5:
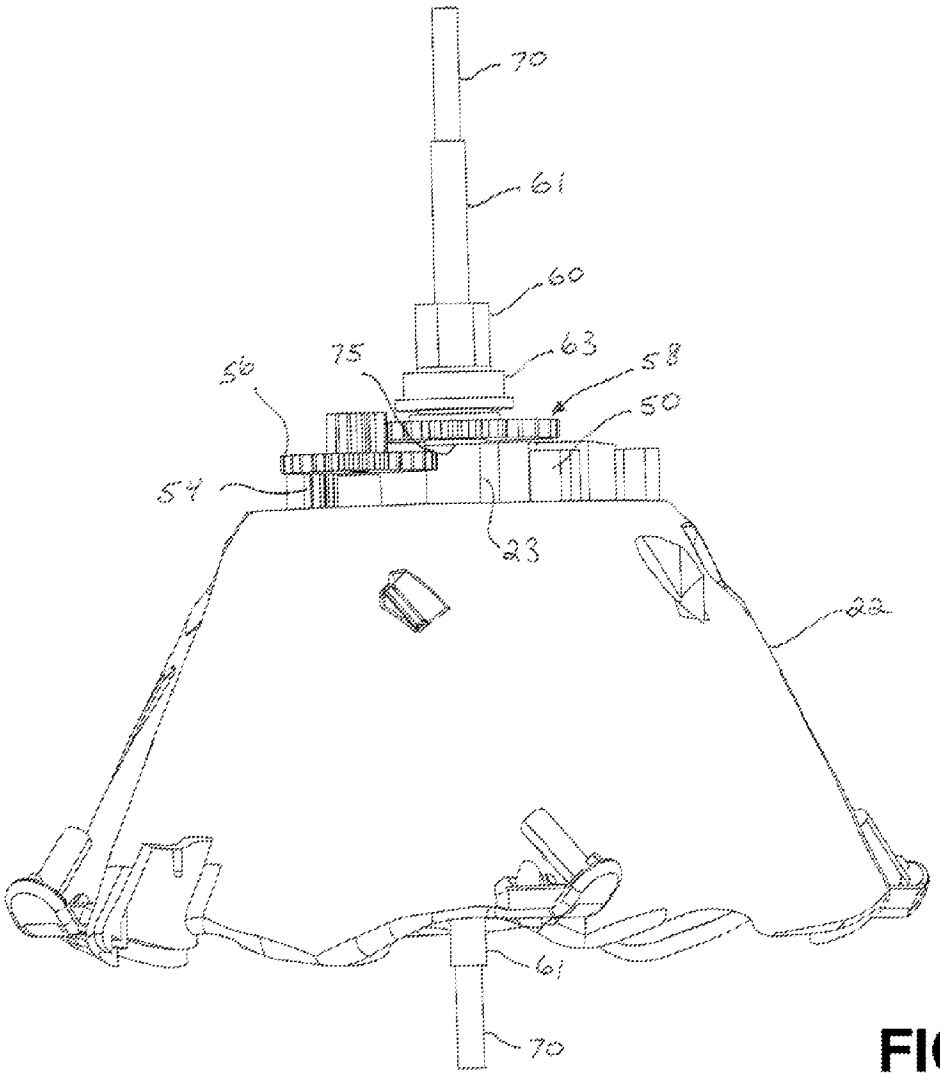
FIG. 5 is a partially assembled view of the flying toy figurine showing the skirt portion, the drive gears, the gear plate, the top bearing, the center tube and the center shaft.

To control and maintain the height of the flying toy figurine 1 at a pre-determined distance above a surface or object, a flight control system is provided. As shown in FIGS. 2, 3 and 4, the flight control system includes circuitry on circuit board 80 which includes connections for communication with a transmitter 90 and a receiver 92 inserted though openings in the skirt bottom 25. The transmitter may be an infrared transmitter, such as an LED emitter, and the receiver may be an infrared receiver, however, other transmitter/receiver pairs may be used. During flight, the transmitter 90 sends a flight control signal directed vertically downward and the receiver 92 and measures the strength of the reflection of the flight control signal from the ground or any surface or object that may be inserted between the ground and the transmitter 90. Control circuits on circuit board 80 then adjust the power transmitted to motor 52 to drive the rotor assembly 30 either faster or slower, depending on the strength of the reflected flight control signal, to thereby maintain the predetermined height of the flying toy figurine 1 above the surface or object. If the strength of the reflected flight control signal received by the receiver 92 is less than a pre-determined value, it means that the flying toy figurine 1 is higher than the pre-determined distance above the surface or object and power to motor 52 is reduced. If the strength of the reflected flight control signal received by the receiver 92 is greater than a pre-determined value, it means that the flying toy figurine 1 is lower than the pre-determined distance above the surface or object and power to motor 52 is increased.

In a further embodiment, circuit board 80 may be fitted with a receiver to receive wireless control signals from a remote transmitter, such as radio frequency signals or infrared signals. The remote transmitter may be used to send and the receiver may be used to receive wireless control signals for turning the power on and off, and/or for controlling the amount of power sent to the motor 52 to drive the rotor assembly 30 at different speeds to thereby control the height of the flying toy figurine 1 above a surface or object. The above-described wireless remote control transmitter/receive combination may be used as an alternative to the above-described flight control system to control and maintain the height of the flying toy figurine 1 above a surface or object.

Included on circuit board 80 for safety purposes is a cutoff switch designed to cut power to the rotor assembly 30 when electric current to the drive motor 52 increases above a pre-determined amount. If the main propeller blades encounter an obstacle such as a wall, the floor, or a person's hand, the current being sent to the motor will increase as the motor attempts to overcome the obstacle. If the current increases beyond a pre-determined limit, power to the motor 52 is cut and the rotor assembly 30 stops. This is a safety feature design to prevent injury to the user.

To operate the flying toy figurine 1, a user charges the battery 50 by plugging charging port 86 into a charging unit for a period of time until the battery is fully charged. Switch 82 is moved to the "on" position and the flying toy figurine 1 is oriented in a substantially vertical position, as shown in FIG. 1. At this point, motor 52 is activated, driving the rotor assembly 30, providing lift and causing the flying toy figurine 1 to fly. Motor 52 may be activated by a wireless control signal sent by a remote transmitter, or the motor may turn on with movement of the switch 82 to the "on" position.

Rotor assembly 30, including main propeller blades 32, is driven by motor 52 in one rotational direction. Counter-rotational torque produced by driving the main propeller blades 32 causes hip portion 20, including the secondary propeller blades 34 to spin on top bearing 63 in the opposite rotational direction. Since center shaft 70 runs freely through center tube 61 and is not attached to either of the waist portion 18, the rotor assembly 30, or the hip portion 20, upper body portion 12 and lower body portion 14 will remain stationary. In reality, the center shaft 70 may turn slowly in one direction or the other, depending upon slight differences in rotational friction between the counter-rotating components that come in frictional contact with center shaft 70. These differences are due to the speed of rotation of the counter-rotating components, surface finish, lubrication and size tolerances. For example, as the main pivot 62 begins to rotate, it pushes up slightly and makes contact with the base of the upper body fixer 72 imparting some rotational force to the center shaft 70 in the direction of rotation of the main propeller blades 32. At the same time center tube 61, which is fixed to skirt tube 23, begins to rotate with the hip portion 20 in the opposite direction due to the counter-rotational torque produce by driving the main propeller blades 32. Rotational frictional produced by contact between center tube 61 and center shaft 70, will tend to cause center shaft 70 to rotate in a direction opposite the direction of the rotation of main propeller blades 32. At times these two counter-rotational forces will balance, and upper body portion 12 and lower body portion 14 will remain stationary relative to the middle body portion 16. At other times, one of the counter-rotational forces may be greater than the other, and the upper and lower body portions 12, 14 will rotate slowly in one direction or the other. At times, during rapid ascending or descending of the flying toy figurine 1, the direction of rotation may change due to changes in the counter-rotational forces. At all times, however, center shaft 70 remains independent of the rotation of waist portion 18 and the hip portion 20, and the rate of rotation of the upper and lower body portions 12, 14 will be a small fraction of the rate of rotation of the main propeller blades 32 and the secondary propeller blades 34. The stationary appearance, or slow rate of rotation of the upper and lower body portions 12, 14, relative to the rapidly spinning main and secondary propeller blades 32, 34, gives the flying toy figurine 1 a unique appearance that provides a further sense of enjoyment and amazement to the user.

To control and maintain the height of the flying toy figurine 1 at a pre-determined distance above a surface or object, transmitter 90 sends a flight control signal directed vertically downward and the receiver 92 measures the strength of the reflection of that signal from the ground or any surface or object that may be inserted between the ground and the transmitter 90. Control circuits on circuit board 80 then adjust the power transmitted to motor 52 to drive the rotor assembly 30 either faster or slower, depending on the strength of the reflected signal, to thereby maintain the predetermined height of the flying toy figurine 1 above the surface or object. If the strength of the reflected signal received by the receiver 92 is less than a pre-determined value, it means that the flying toy figurine 1 is higher than the pre-determined distance above the surface or object and power to motor 52 is reduced. If the strength of the reflected signal received by the receiver 92 is greater than a pre-determined value, it means that the flying toy figurine 1 is lower than the pre-determined distance above the surface or object and power to motor 52 is increased.

The previous detailed description is provided to enable any person skilled in the art to make or use the present flying toy figurine. Various modifications to those embodiments will be readily apparent to those skilled in the art, and the generic principles defined herein may be applied to other embodiments without departing from the scope of the periodontal probe as defined by the appended claims. Thus, the present flying toy figurine is not intended to be limited to the embodiments shown herein, but is to be accorded the full scope consistent with the appended claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A flying toy figurine comprising:

a) a main body, the main body comprising an upper body portion, a lower body portion and a middle body portion, the middle body portion comprising a waist portion and a hip portion;

b) a center shaft located on a central axis of the main body, the center shaft being adapted for mounting on the central axis, the center shaft being annularly spaced from a center tube and extending through the center tube for rotation therein, and thereby free to rotate 360 degrees about the central axis, a first end of the center shaft being fixed to the upper body portion and a second, opposite end of the center shaft being fixed to the lower body portion;

c) a rotor assembly located in the waist portion;

d) a drive motor for driving the rotor assembly and the waist portion in a first rotational direction, the rotor assembly including at least two main propeller blades for providing aerodynamic lift to the flying toy figurine;

e) the hip portion including at least two secondary propeller blades connected to and extending radially outward from the hip portion;

f) a source of power for running the drive motor;

g) a control system for regulating operation of the drive motor; and h) the waist portion and the hip portion being mounted concentrically about and annularly spaced from the center shaft for rotation about the center shaft, said rotation of the waist portion and the hip portion about the center shaft being independent of rotation of the center shaft, the hip portion being adapted for rotation in a second rotational direction opposite the first rotational direction;

wherein running the drive motor to drive the rotor assembly and waist portion in the first rotational direction imparts aerodynamic lift causing the flying toy figurine to fly and further causing the hip portion to rotate in the second rotational direction opposite the first rotational direction.

2. The flying toy figurine of claim 1, wherein the drive motor is located in the hip portion.

3. The flying toy figurine of claim 1, wherein the center tube is fixed to the hip portion and is annularly spaced from the center shaft.

4. The flying toy figurine of claim 1, wherein the main propeller blades are hingeably connected to the rotor assembly.

5. The flying toy figurine of claim 1, wherein the rotor assembly includes a pair of stabilizer bars extending from the waist portion for rotation therewith.

6. The flying toy figurine of claim 1, wherein outer tips of the main propeller blades include protective wire loops.

7. The flying toy figurine of claim 1, wherein the hip portion includes at least two secondary propeller blades connected to and extending radially outward thereof.

8. The flying toy figurine of claim 1, wherein the secondary propeller blades are hingeably connected to the hip portion.

9. The flying toy figurine of claim 1, wherein the secondary propeller blades are weighted along bottom edges thereof.

10. The flying toy figurine of claim 1, wherein secondary propeller blades are connected to the hip portion at an angle relative to the central axis.

11. The flying toy figurine of claim 1, wherein the control system includes a first transmitter for transmitting flight control signals and a first receiver for receiving the flight control signals after the flight control signals have reflected off of a surface, and control circuitry for controlling and maintaining the height of the flying toy figurine above the surface by measuring the strength of the flight control signals reflected off of the surface and adjusting the amount of power transmitted to the motor relative to the strength of the reflected flight control signals.

12. The flying toy figurine of claim 11, wherein the control system includes a second receiver for receiving wireless flight control signals and a second remote transmitter for transmitting the wireless flight control signals, and where the control circuitry includes means for turning the motor on and off in response to the wireless control signals.

13. The flying toy figurine of claim 1, wherein the control system includes a receiver for receiving wireless control signals and a remote transmitter for transmitting the wireless control signals to the receiver, and control circuitry for turning the motor on and off and for controlling and maintaining the height of the flying toy figurine above a surface in response to the wireless control signals.

14. The flying toy figurine of claim 1, wherein the control system includes a motor cut-off switch to cut power to the drive motor when electric current to the drive motor increases above a predetermined amount.

15. The flying toy figurine of claim 1, wherein the waist portion is decoupled from the hip portion so that the waist portion and the hip portion are independently rotatable so that running the drive motor to drive the rotor assembly and waist portion in the first rotational direction imparts a counter-rotational force to the hip portion causing the hip portion to rotate in the second rotational direction opposite the first rotational direction.

16. A flying toy figurine comprising:

a) a main body, the main body comprising an upper body portion, a lower body portion and a middle body portion, the middle body portion comprising a waist portion and a hip portion;

b) a center shaft located on a central axis of the main body, the center shaft being adapted for mounting on the central axis, the center shaft being annularly spaced from a center tube and extending through the center tube for rotation therein, and thereby free to rotate 360 degrees about the central axis, a first end of the center shaft being fixed to the upper body portion and a second, opposite end of the center shaft being fixed to the lower body portion;

c) a rotor assembly located in the waist portion d) a drive motor for driving the rotor assembly and the waist portion in a first rotational direction, the rotor assembly including at least two main propeller blades for providing aerodynamic lift to the flying toy figurine;

e) the hip portion including at least two secondary propeller blades connected to and extending radially outward from the hip portion;

f) a source of power for running the drive motor;

g) a control system for regulating the operation of the drive motor; and h) the waist portion and the hip portion being mounted concentrically about and annularly spaced from the center shaft for rotation about the center shaft, said rotation of the waist portion and the hip portion about the center shaft being independent of rotation of the center shaft, the hip portion being adapted for rotation in a second rotational direction opposite the first rotational direction, wherein running the drive motor to drive the rotor assembly and waist portion in the first rotational direction imparts aerodynamic lift causing the flying toy figurine to fly.

17. The flying toy figurine of claim 16, wherein running the drive motor to drive the rotor assembly and waist portion in the first rotational direction causes the hip portion to rotate in the second rotational direction opposite the first rotational direction.

18. The flying toy figurine of claim 17, wherein the waist portion is decoupled from the hip portion so that the waist portion and the hip portion are independently rotatable so that running the drive motor to drive the rotor assembly and waist portion in the first rotational direction imparts a counter-rotational force to the hip portion causing the hip portion to rotate in the second rotational direction opposite the first rotational direction.

* * * * *